US007178802B2

(12) United States Patent
Nally et al.

(10) Patent No.: US 7,178,802 B2
(45) Date of Patent: Feb. 20, 2007

(54) HOCKEY GAME TABLE WITH GOAL HANDICAP FEATURE

(75) Inventors: Michael Nally, Ridgewood, NJ (US); David Rossi, Newton, NJ (US)

(73) Assignee: Sportcraft, Ltd.

( * ) Notice: Subject to any disclaimer, the term of this patent is extended or adjusted under 35 U.S.C. 154(b) by 0 days.

(21) Appl. No.: 10/993,137

(22) Filed: Nov. 19, 2004

(65) Prior Publication Data

US 2005/0161878 A1 Jul. 28, 2005

(51) Int. Cl.
*A63F 7/36* (2006.01)
*A63F 7/07* (2006.01)

(52) U.S. Cl. ..... 273/108; 273/108.1; 273/126 R; 273/126 A

(58) Field of Classification Search ..... 273/126 R, 273/126 A, 127 R, 127 B, 108.1, 108.5, 273/118 R, 118 A, 119 R, 119 A, 121 R, 273/121 A, 354, 348, 148 B
See application file for complete search history.

(56) References Cited

U.S. PATENT DOCUMENTS

| | | | | | |
|---|---|---|---|---|---|
| 709,144 | A | | 9/1902 | Edgerly | |
| 2,010,282 | A | * | 8/1935 | Wanncmacher | 473/2 |
| 3,105,685 | A | * | 10/1963 | Jahn | 473/55 |
| 3,722,888 | A | | 3/1973 | Ducharme | |
| 3,931,974 | A | | 1/1976 | Goldfarb et al. | |
| 4,257,603 | A | * | 3/1981 | Harding | 273/126 R |
| 4,775,152 | A | | 10/1988 | Roehl | |
| 5,038,688 | A | * | 8/1991 | Permenter | 108/43 |
| 5,080,375 | A | * | 1/1992 | Moosavi | 473/478 |
| 5,356,143 | A | | 10/1994 | Hylak | |
| 5,375,831 | A | * | 12/1994 | Hsien-Chung | 273/148 B |
| 5,413,340 | A | * | 5/1995 | Potvin et al. | 273/127 B |
| 5,884,911 | A | | 3/1999 | Guridi | |
| 6,022,020 | A | * | 2/2000 | Nishikawa | 273/108 |
| 6,234,476 | B1 | * | 5/2001 | Yamashita et al. | 273/126 A |
| 6,276,682 | B1 | * | 8/2001 | Yamashita et al. | 273/126 A |
| 6,290,228 | B1 | * | 9/2001 | Roberts et al. | 273/148 B |
| RE37,451 | E | | 11/2001 | Guridi | |
| 2003/0116912 | A1 | | 6/2003 | Bangerter | |
| 2005/0161878 | A1 | * | 7/2005 | Nally et al. | 273/108 |

* cited by examiner

*Primary Examiner*—Raleigh W. Chiu
(74) *Attorney, Agent, or Firm*—Fellers, Snider, et al

(57) ABSTRACT

An adjustable goal for use with table top games such as air hockey allows one or both players to independently adjust the width of their respective goals to increase or decrease the difficulty of an opponent to score, i.e., allows a superior player to be handicapped to facilitate more competitive game play. First and second sliding members are slidably attached to a central member. Each of the sliding members may be manipulated to increase or decrease the size of the goal opening. Each sliding member is provided with a linear gear face for engaging a gear mounted on a central member to facilitate equal expansion and contraction of the sliding members. The first and second sliding members may be positioned to selectively define a relatively larger or smaller front opening and rearward opening to compensate for different skill levels of participating players.

9 Claims, 9 Drawing Sheets

HOCKEY GAME TABLE WITH GOAL HANDICAP FEATURE

BACKGROUND OF THE INVENTION

1. Field of the Invention

This invention relates generally to a goal for use with an air cushion game table. More particularly, the invention relates to an adjustable goal for facilitating the handicapping of a superior player to allow for competitive game play between players of unequal ability.

2. Background

Typically, an air cushion game table includes a playing surface that is perforated to permit jets of air to pass through the playing surface for providing an air bed to facilitate low friction movement of a game piece, such as a puck, across an upper surface of the playing surface. Pressurized air is supplied from below the playing surface, which creates a multiplicity of closely spaced air jets emanating from the perforations in the playing surface. The table is bounded by side walls and end walls, which provide rebounding surfaces for the puck. Each player is provided with a pusher, which may be slid across the table surface and into contact with the puck. An automatic scoring system is sometimes provided to record the delivery of pucks into a goal. A drawback associated with known air cushion table games is that players having different skill levels have difficulties playing one another in a competitive game. Lack of competitive play may be particularly evident when children attempt to play adults.

SUMMARY OF THE INVENTION

According to the present invention there is provided an improvement in goals for use with air cushion game tables, such as "air hockey". The adjustable goal of the invention allows one or both players to independently adjust the width of their respective goals to increase or decrease the difficulty of defending his or her goal, i.e., increase or decrease the ease with which his or her opponent may score. The adjustable goal of the invention permits the handicapping of a superior player, which should result in more competitive and therefore more enjoyable play.

In one aspect, the inventive goal includes first and second sliding members which are slidably attached to a central member. The first and second sliding members may be positioned to selectively define a relatively larger or smaller front opening and rearward opening to compensate for different skill levels of participating players.

In another aspect, each sliding member is provided with a linear gear face for engaging a gear mounted on a central member to facilitate equal expansion and contraction of the sliding members. In this manner there is provided infinite adjustability between a maximum width setting and a minimum width setting.

In still another aspect, the sliding members are structured so that the forward opening and rearward opening are maintained in a symmetrical relationship about the central member.

In particular, and with reference to a first embodiment, the adjustable goal of the invention includes a central member having a rearward portion, a forward portion, an upper surface and a lower surface. A forward guide channel is provided on a leading edge of the forward portion of the central member. A rearward guide channel is provided on the central member. A downwardly extending post extends from an elevated portion of the central member and has a gear mounted thereon. A spacer is provided on the post between the gear and the central member.

First and second sliding members are provided having a leading edge, a trailing edge, a forward first wall, a rearward first wall and that define a first surface. The leading edges are provided to slidably engage the forward guide channel of the central member. The trailing edges are provided to slidably engage the rearward guide channel of the central member. Additionally, the first surface defines a first linear gear face for engaging a front side of the gear. The second surface defines a second linear gear face for engaging a rear side of the gear. The forward portion of the central member, the forward first wall and the forward second wall define a front opening for receiving an object such as a puck. The rearward portion of the central member, the rearward first wall and the rearward second wall define a rearward opening for allowing the object to travel to a receptacle.

The first and second sliding members may thus be positioned to selectively define a relatively larger or smaller front and rearward opening. Therefore, the opening size of each goal may be adjusted to compensate for different skill levels of participating players.

In a second embodiment, posts are provided that extend rearwardly from the sliding members of the adjustable goal. Each post fits into one of a plurality of holes provided in an end wall of the game table so that the width of the adjustable goal may be set at a selected repeatable dimension.

A better understanding of the present invention, its several aspects, and its advantages will become apparent to those skilled in the art from the following detailed description, taken in conjunction with the attached drawings, wherein there is shown and described the preferred embodiment of the invention, simply by way of illustration of the best mode contemplated for carrying out the invention.

DETAILED DESCRIPTION OF THE PREFERRED EMBODIMENT

Before explaining the present invention in detail, it is important to understand that the invention is not limited in its application to the details of the embodiments and steps described herein. The invention is capable of other embodiments and of being practiced or carried out in a variety of ways. It is to be understood that the phraseology and terminology employed herein is for the purpose of description and not of limitation.

Figure 1:
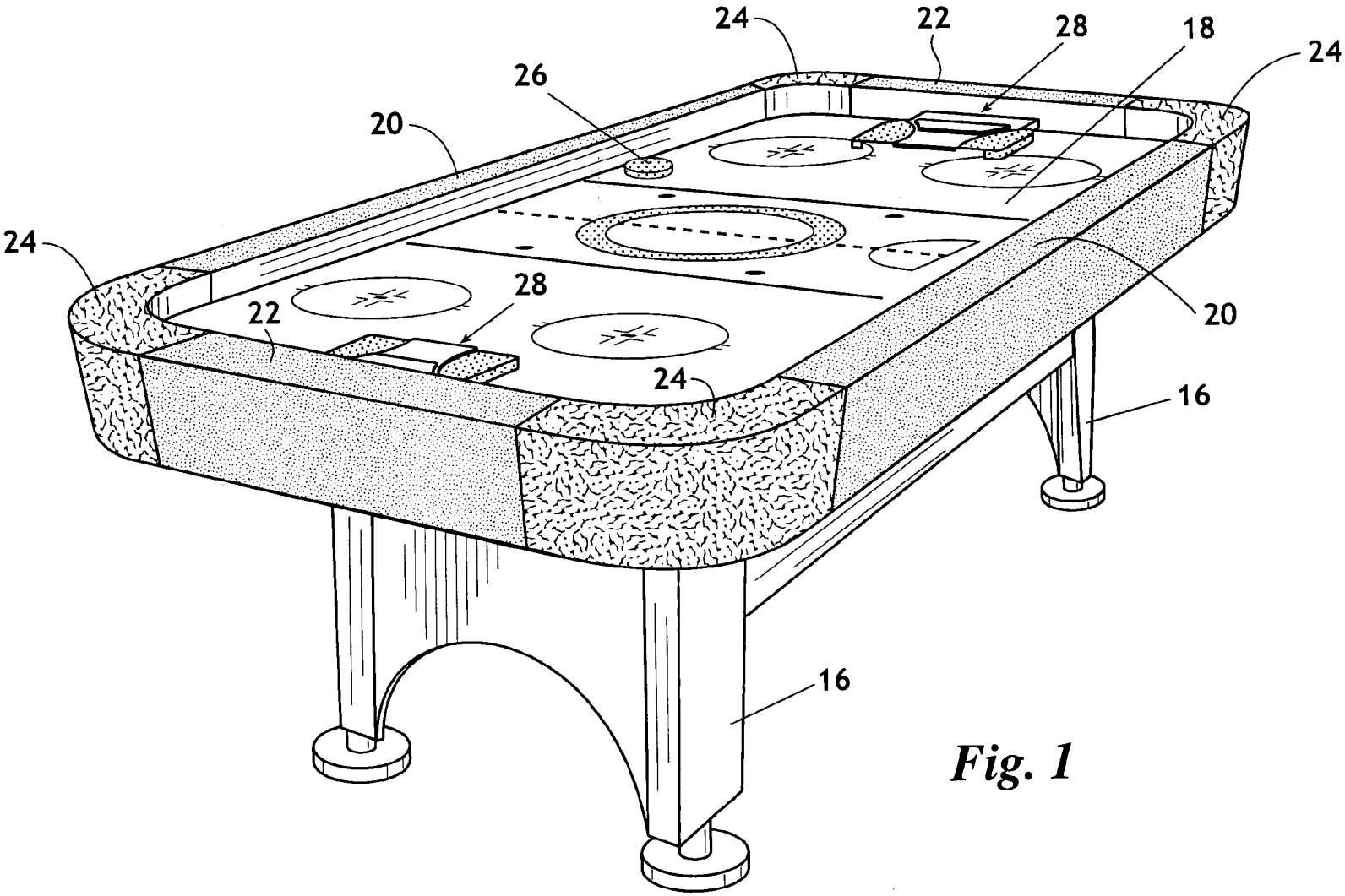
FIG. 1 is a perspective view of an air cushion gaming table utilizing adjustable goals of the invention.
Figure 3:
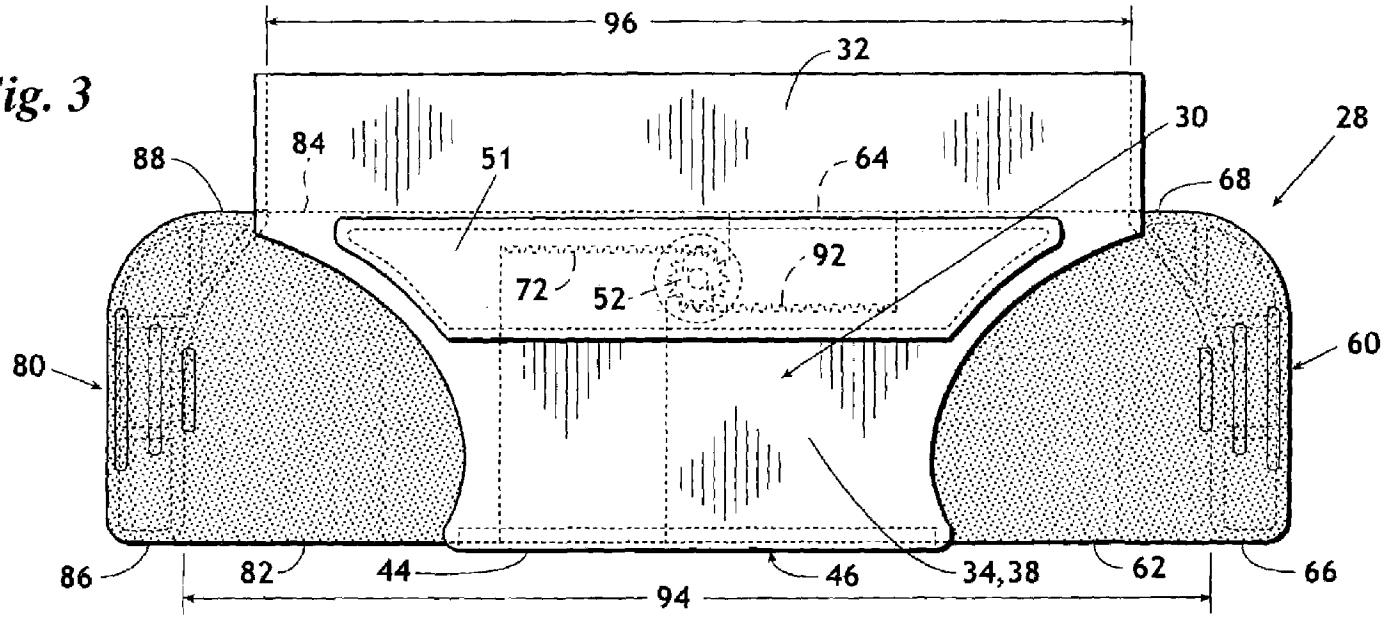
FIG. 3 is a top view of an adjustable goal of the invention taken along line 3—3 of FIG. 2.
Figure 2:
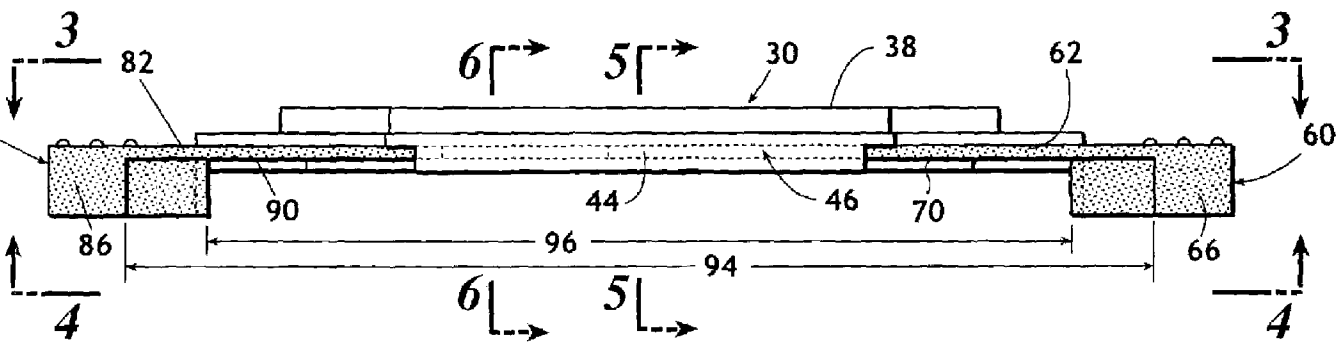
FIG. 2 is a front view of an adjustable goal of the invention shown in a fully retracted configuration.
Figure 6:
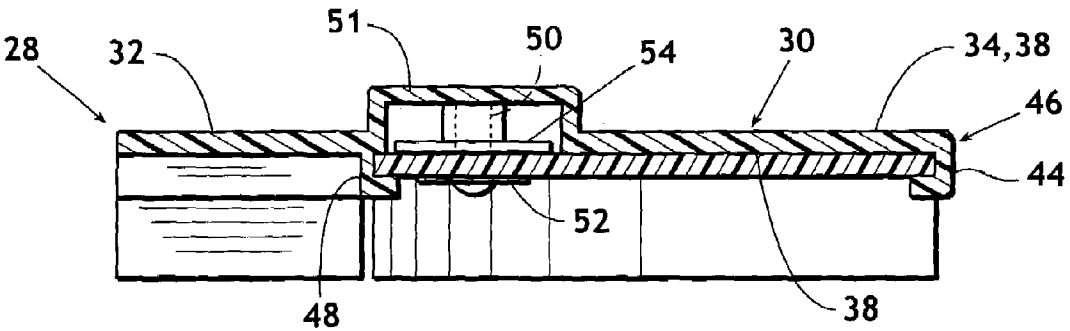
FIG. 6 is a cross-sectional view of an adjustable goal taken along line 6—6 of FIG. 2.
Figure 4:
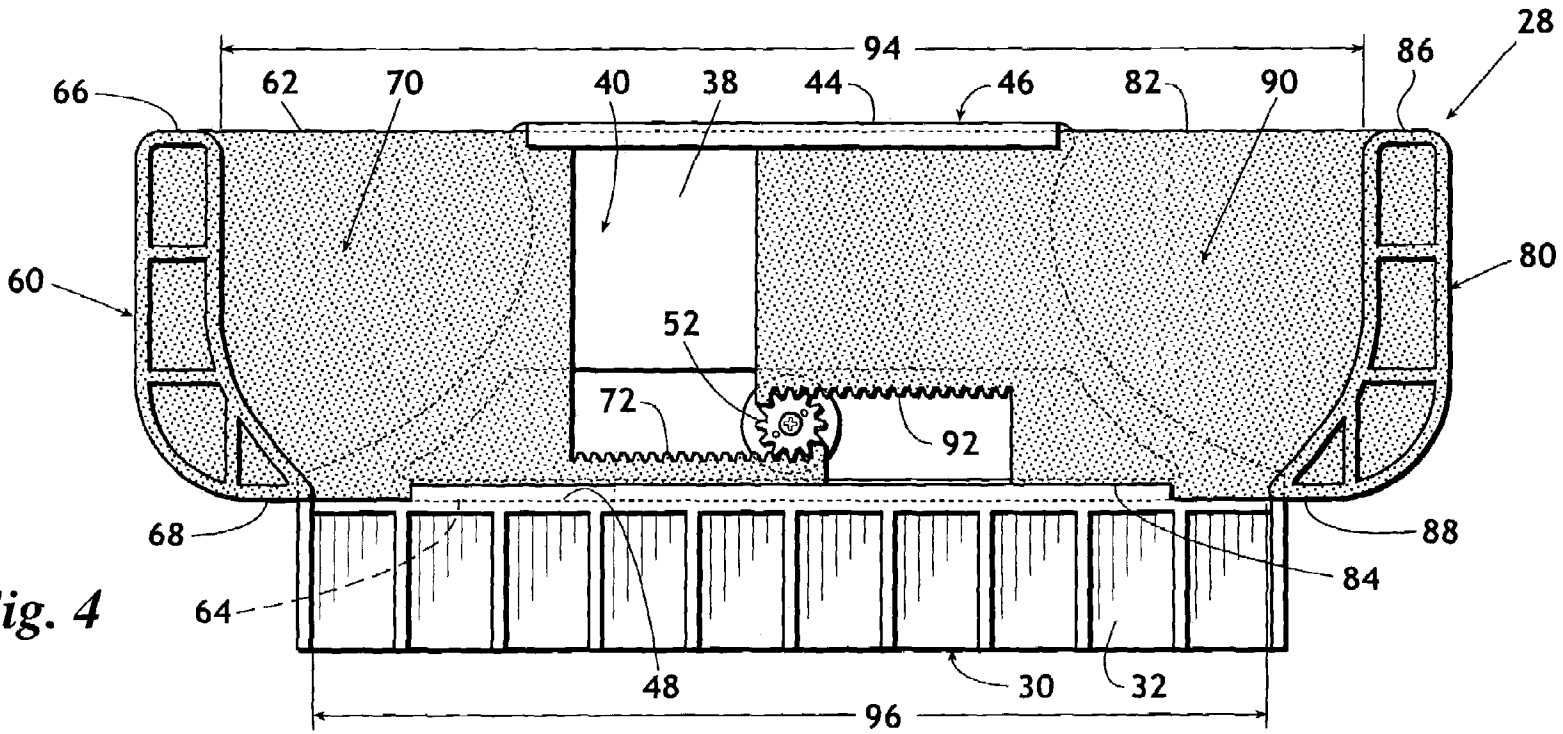
FIG. 4 is a bottom plan view of an adjustable goal of the invention taken along lines 4—4 of FIG. 2.
Figure 5:
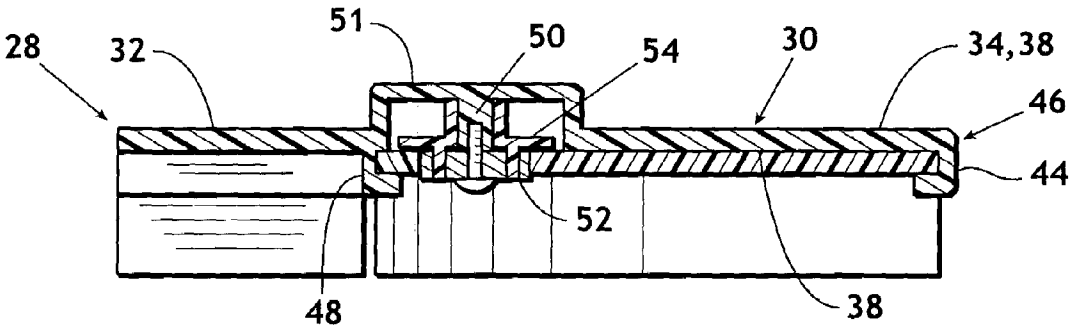
FIG. 5 is a cross-sectional view of the adjustable goal taken along line 5—5 of FIG. 2.
Figure 9:
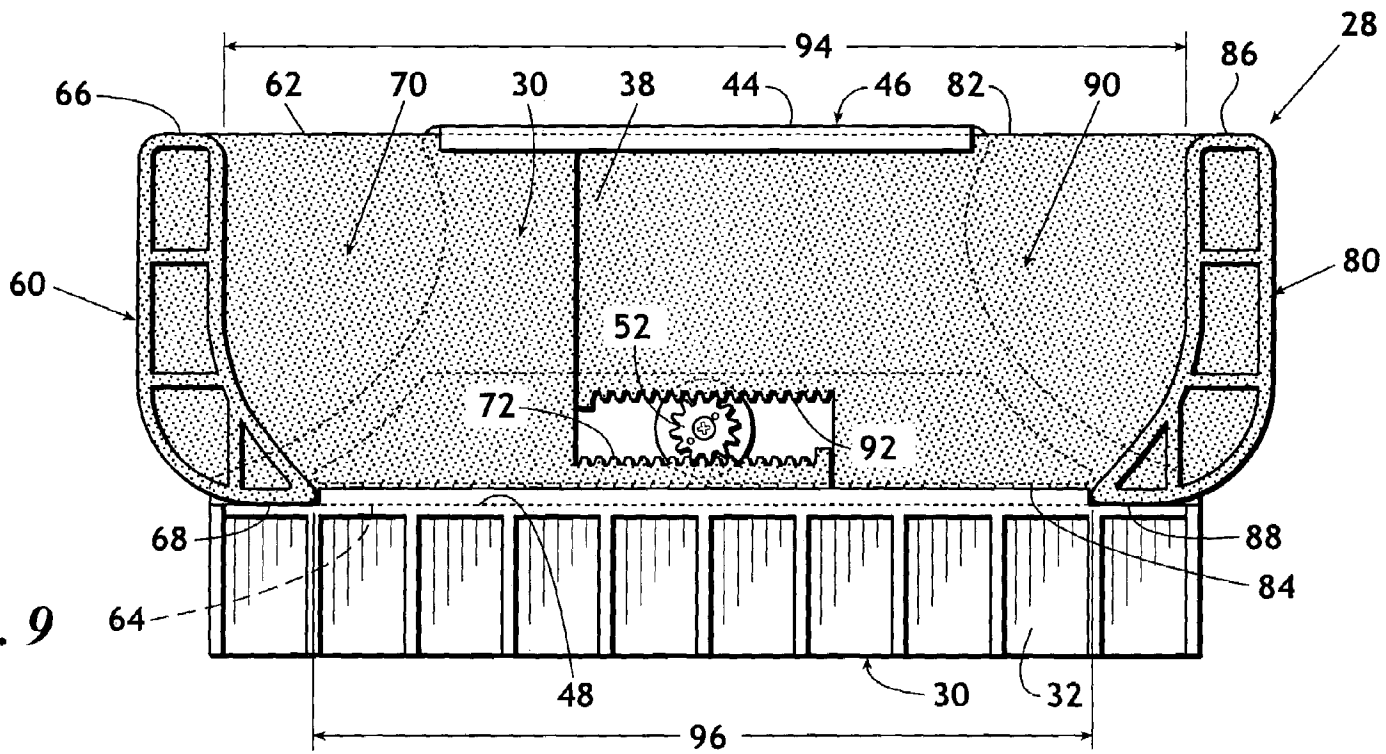
FIG. 9 is a bottom view taken along line 9—9 of FIG. 7.
Figure 8:
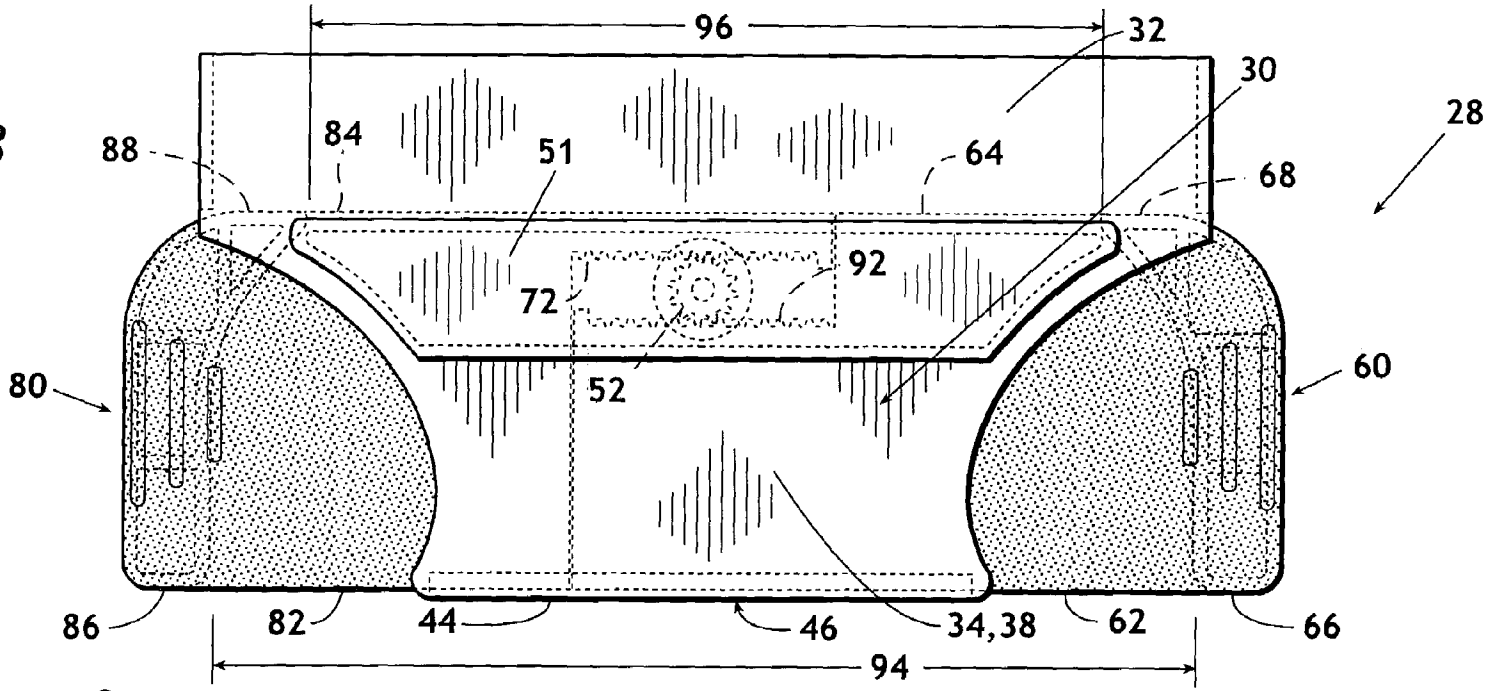
FIG. 8 is a top view taken along line 8—8 of FIG. 7.
Figure 7:
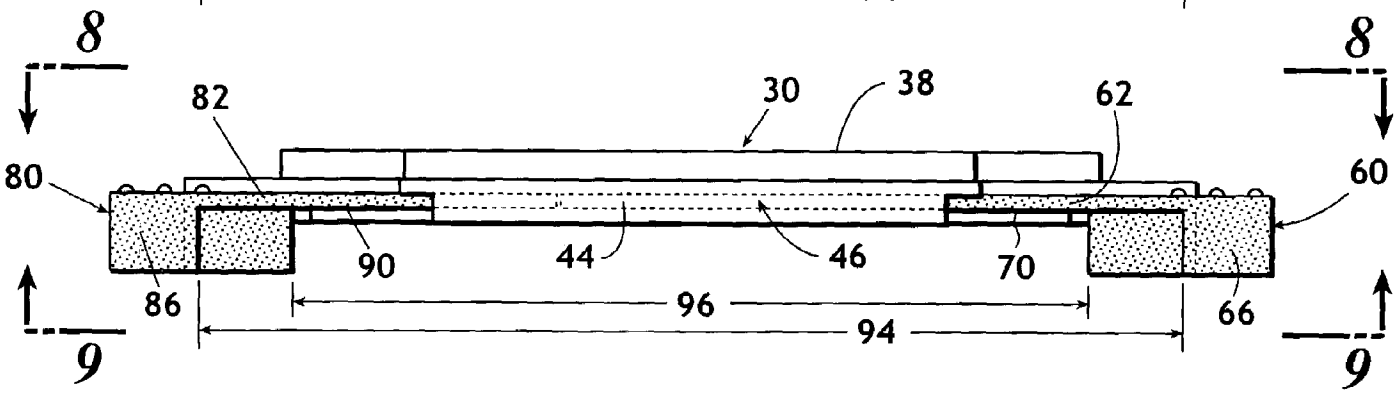
FIG. 7 is a front view of an adjustable goal of the invention shown in a fully expanded position.
Figure 11:
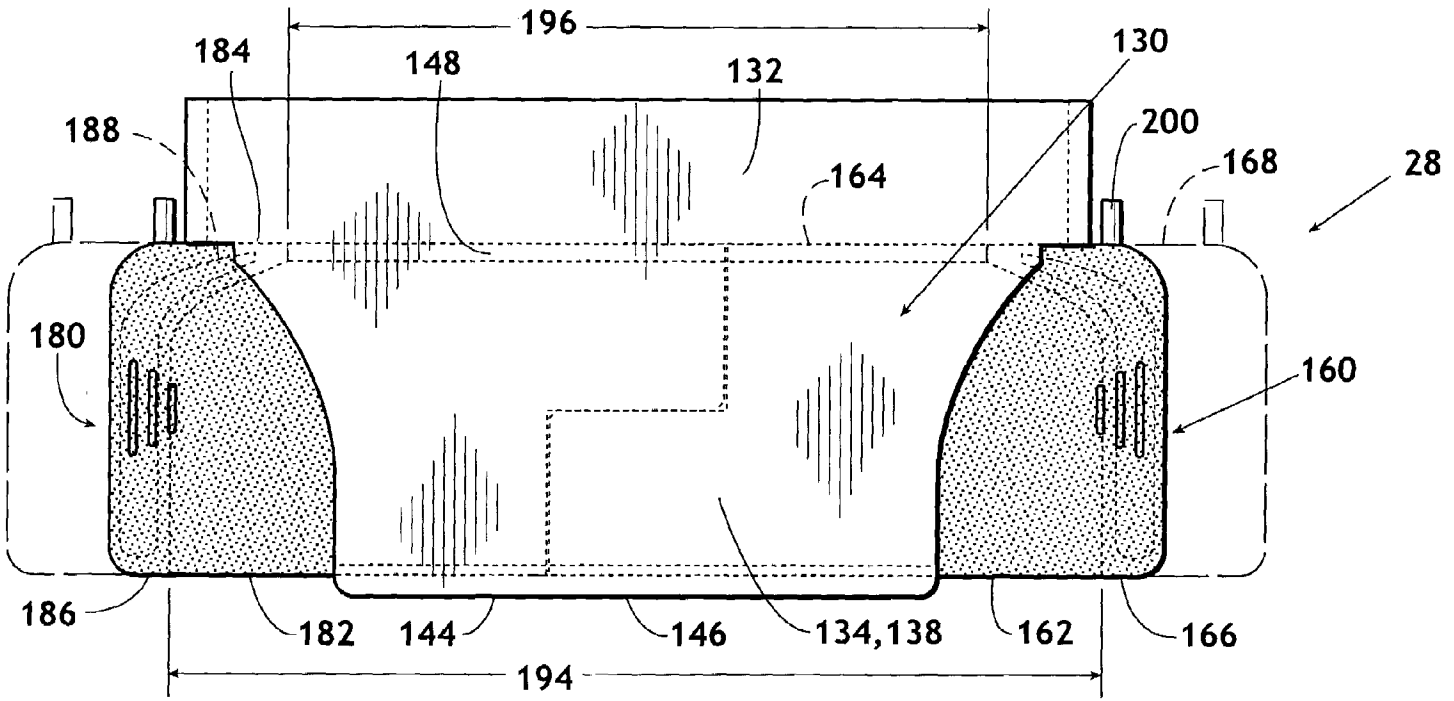
FIG. 11 is a top view taken along line 11—11 of FIG. 10.
Figure 10:
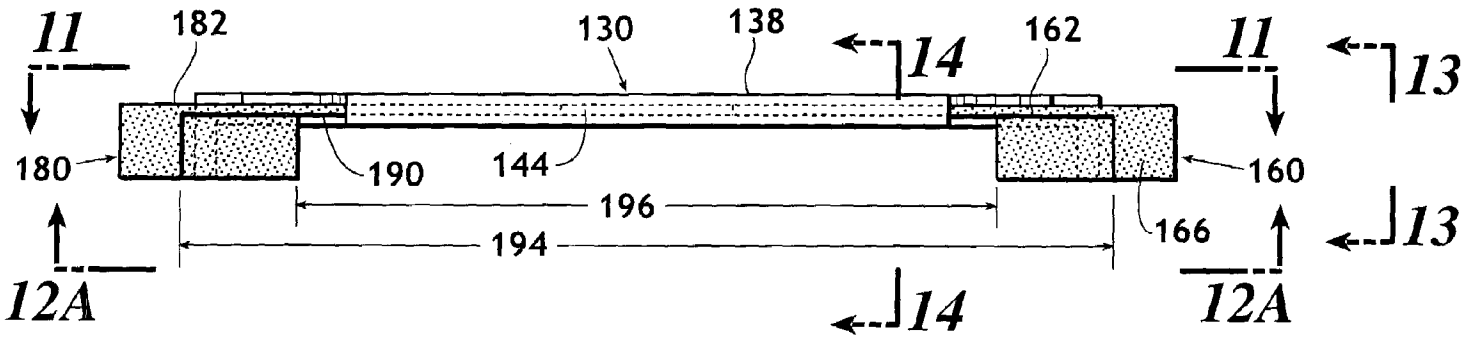
FIG. 10 is a front view of a second embodiment of the invention.
Figure 12A:
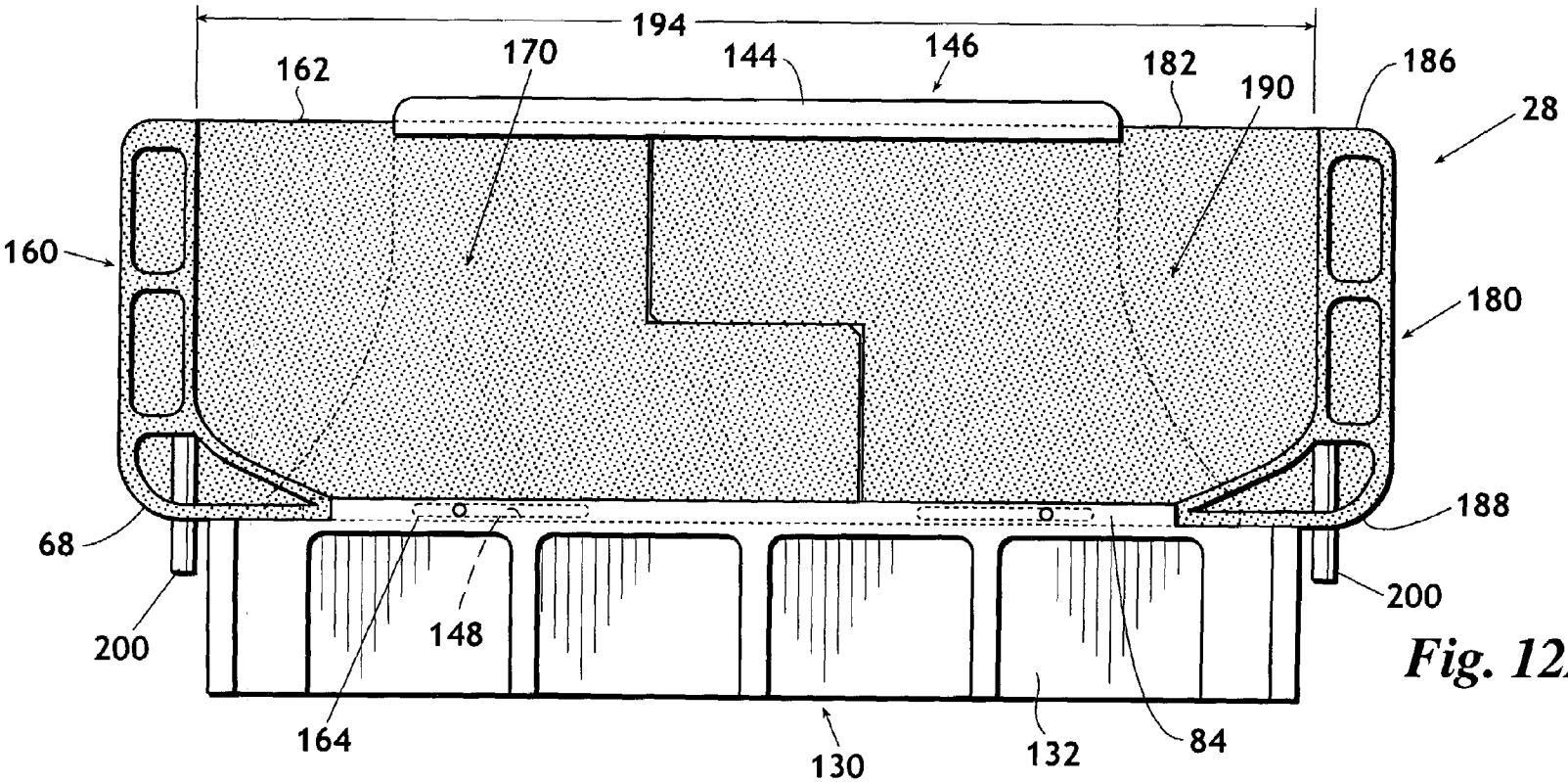
FIG. 12A is a bottom view of an adjustable goal in a retracted position taken along line 12—12 of FIG. 10.
Figure 13:
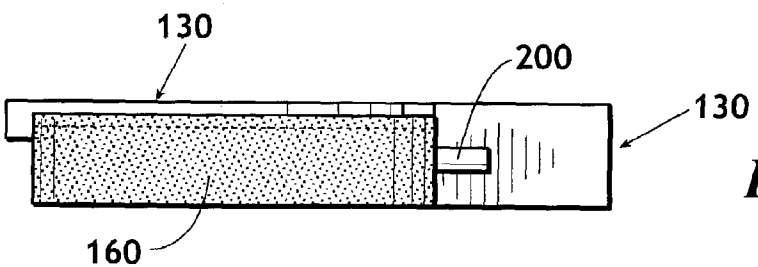
FIG. 13 is a side view taken along line 13—13 of FIG. 10.
Figure 12B:
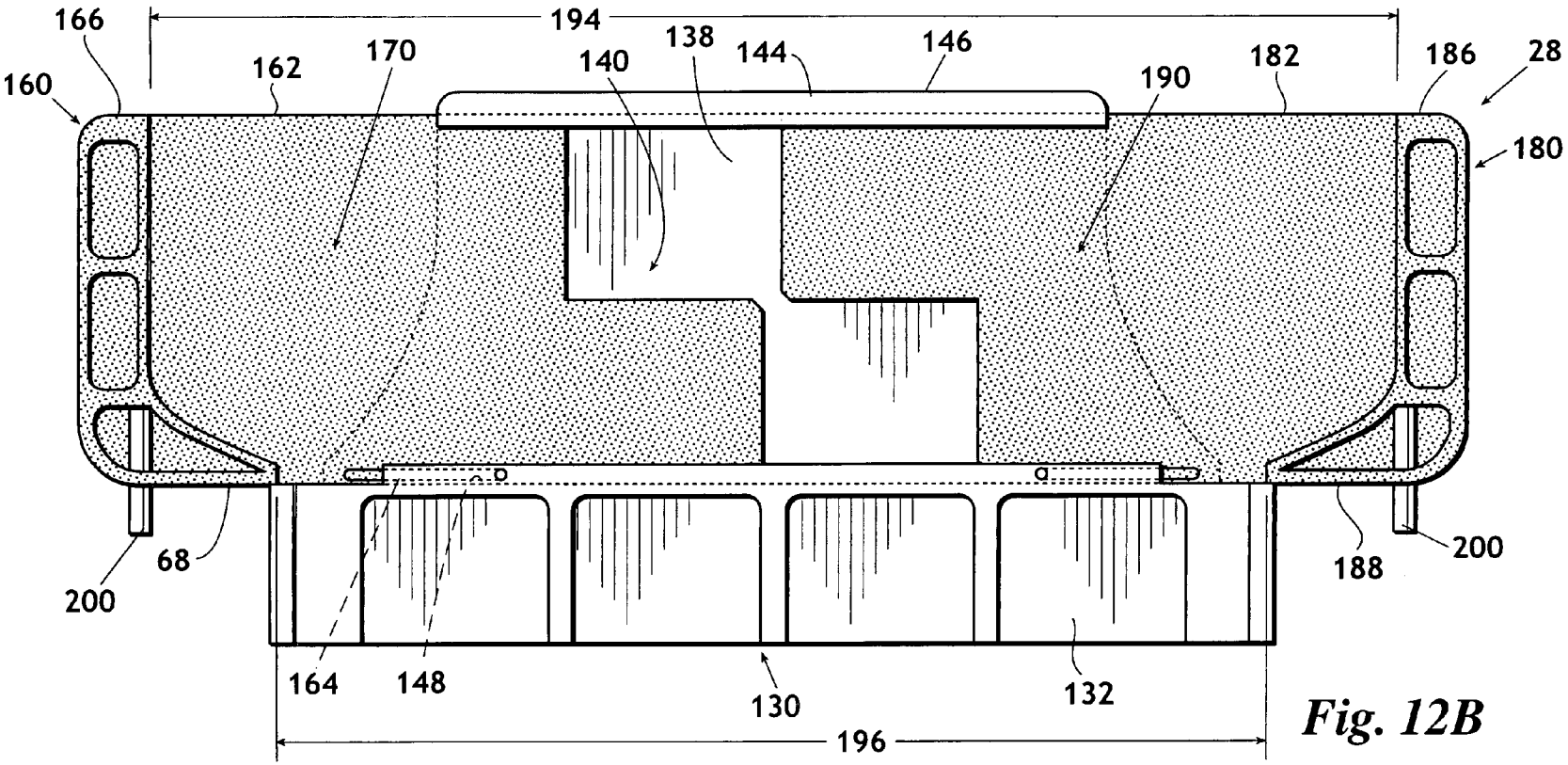
FIG. 12B is a bottom view of an adjustable goal in an expanded position taken along line 12—12 of FIG. 10.
Figure 14:
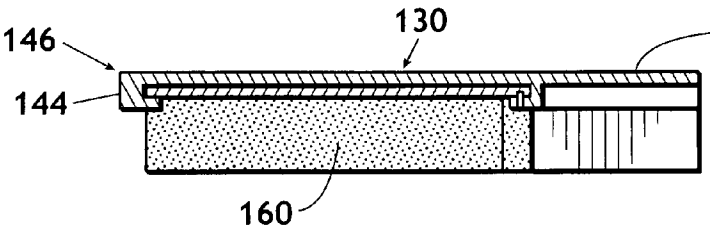
FIG. 14 is a cross-sectional view taken along line 14—14 of FIG. 10.
Figure 15:
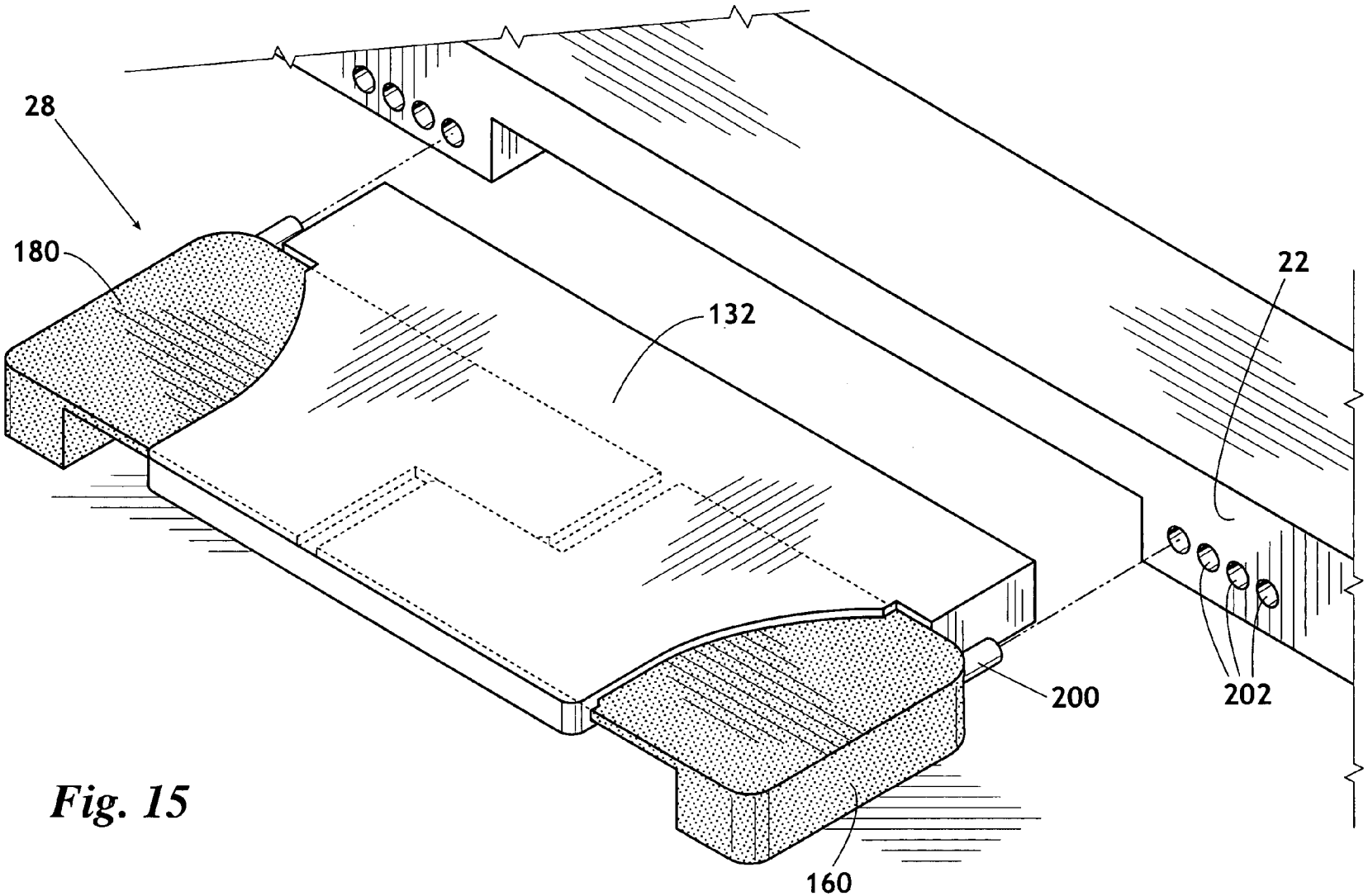
FIG. 15 is a perspective view of the adjustable goal of FIG. 10 located on an air hockey table.

Referring first to FIG. 1, shown is an air cushion game table 10. Four support legs 16 support the game table 10. A game surface 18 has a plurality of small openings formed therein for allowing jets of air to flow through the game surface 18. The air jets provide an air cushion on an upper side of the game surface 18.

Game surface 18 is surrounded by side walls 20, end walls 22, and corner members 24 for containing a puck 26 on the upper surface of game surface 24. Adjustable goals 28 are located proximate each end wall 22 for receiving the puck 26. Adjustable goals 28 may be integral with end wall 22 or may be formed on the game surface 18. A puck return tray is located beneath game surface 18 for delivering the puck 26 to a player after the puck 26 is received by a goal 28.

Referring now to FIGS. 2–9, a first embodiment 27 of adjustable goal 28 is shown in greater detail. Embodiment 27 includes a central member 30. Central member 30 has a rearward portion 32 and a forward portion 34. Central member 30 additionally defines an upper surface 38 and a lower surface 40. Preferably, a forward guide channel 44 is formed on a forward edge 46 of the forward portion 34 of central member 30. Additionally, a rearward guide channel 48 is preferably also formed on central member 38. A downwardly extending post 50 extends from an underside of elevated portion 51 of central member 30. Gear 52 is rotationally mounted on post 50. Gear 52 is maintained a distance away from elevated portion 51 of lower surface 40 by use of spacer 54.

A first sliding member 60 is provided that is slidably engaged with central member 30. First sliding member 60 has a leading edge 62, a trailing edge 64, a forward first wall 66, and a rearward first wall 68. An interior portion of first sliding member 60 is provided with a first surface 70. Leading edge 62 is slidably received within forward guide channel 44 of central member 30. Trailing edge 64 of first sliding member 60 is slidably received by rearward guide channel 48 of central member 30. First surface 70 of first sliding member 60 defines a first linear gear face 72. First linear gear face 72 preferably engages one side of gear 52.

A second sliding member 80 is provided that is slidably engaged with central member 30. Second sliding member 80 has a leading edge 82, a trailing edge 84, a forward second wall 86, and a rearward second wall 88. An interior portion of second sliding member 80 is provided with a second surface 90. Leading edge 82 is slidably received within forward guide channel 64 of central member 30. Trailing edge 84 of second sliding member 80 is slidably received by rearward guide channel 68 of central member 30. Second surface 90 of second sliding member 80 defines a second linear gear face 92. Second linear gear face 92 preferably engages one side of gear 52. First sliding member 60 and second sliding member 80 define a forward opening 94 and a rearward opening 96.

Referring now to FIGS. 10–15, a second embodiment 127 of adjustable goal 28 is shown in greater detail. Embodiment 127 includes a central member 130. Central member 130 has a rearward portion 132 and a forward portion 134. Central member 130 additionally defines an upper surface 138 and a lower surface 140. Preferably, a forward guide channel 144 is formed on a forward edge 146 of the forward portion 134 of central member 130. Additionally, a rearward guide channel 148 is preferably also formed on central member 138.

A first sliding member 160 is provided that is slidably engaged with central member 130. First sliding member 160 has a leading edge 162, a trailing edge 164, a forward first wall 166, and a rearward first wall 168. An interior portion of first sliding member 160 is provided with a first surface 170. Leading edge 162 is slidably received within forward guide channel 144 of central member 130. Trailing edge 164 of first sliding member 160 is slidably received by rearward guide channel 148 of central member 130.

A second sliding member 180 is provided that is slidably engaged with central member 130. Second sliding member 180 has a leading edge 182, a trailing edge 184, a forward second wall 186, and a rearward second wall 188. An interior portion of second sliding member 180 is provided with a second surface 190. Leading edge 182 is slidably received within forward guide channel 164 of central member 130. Trailing edge 184 of second sliding member 180 is slidably received by rearward guide channel 168 of central member 130. First sliding member 160 and second sliding member 180 define a forward opening 194 and a rearward opening 196.

In one embodiment, posts 200 (FIGS. 11, 12A, 12B, 15) are provided that extend rearwardly from the sliding members 160, 180 for selective engagement with one of several holes 202 (FIG. 14) provided in end walls 22. Preferably, a plurality of holes 202 is provided in end walls 22 on either side of goals 28. Providing a plurality of holes 202 in end walls 22 allows for sliding members 160, 180 to be extended in repeatable discrete increments so that the same handicap may be applied to a selected player during multiple gaming sessions, i.e., the size of the goal opening 194 may be set at repeatable discrete increments.

In use, adjustable goals 28 may be adjusted to compensate for a disparity in skill between two players. For example, a highly skilled player may wish to adjust his or her adjustable goal 28 so that forward opening 94, 194 has a maximum width, as shown in FIGS. 2–4 and 12B while a player of lesser skill may wish to adjust his or her goal so that forward opening 94, 194 has a minimum width, as shown in FIGS. 7–9 and 12A. Similarly, two players having highly effective offensive skills without commensurate defensive skills may wish make scoring more difficult by narrowing the width of the forward openings 94, 194 for their respective adjustable goals 28. To expand or retract forward opening 94, 194 and rearward opening 96, 196, sliding members 60, 80, 160, 180 is grasped and moved either toward or away from central member 30, 130. In one embodiment, gear 52 ensures that both sliding members 60, 80 are equidistant from a centerline of central member 30 via engagement with linear gear faces 72, 92. In another embodiment, sliding members 160, 180 may be moved independently and then secured at a desired width by inserting posts 200 within holes 202 provided in end walls 22.

Advantages of one embodiment of adjustable goals 28 of the invention include infinite adjustability between a maximum width setting and a minimum width setting. By permitting the goals to be infinitely and independently adjustable, players of different skill levels are afforded the opportunity to play competitive matches.

A further advantage associated with adjustable goals 28 is that the forward opening 94, 194 and rearward opening 96, 196 of adjustable goals 28 may be easily maintained in a symmetrical relationship about central member 30.

While the invention has been described with a certain degree of particularity, it is understood that the invention is not limited to the embodiment(s) set for herein for purposes of exemplification, but is to be limited only by the scope of the attached claim or claims, including the full range of equivalency to which each element thereof is entitled.

What is claimed is:

1. An adjustable goal for a table top air hockey game comprising:

a central member defining a first receiving area on a first side and a second receiving area on a second side;

a first sliding member slidably engaged with said central member in said first receiving area;

a second sliding member slidably engaged with said central member in said second receiving area;

wherein said first sliding member and said second sliding member are partially hidden by said central member, said first sliding member and said second sliding member defining a forward goal opening having a selectively adjustable width.

2. The adjustable goal according to claim 1 further comprising:

a first gear face defined by said first sliding member;

a second gear face defined by said second sliding member;

a gear affixed to said central member; and wherein said gear engages said first gear face and said second gear face for coordinating movements of said first sliding member and said second sliding member.

3. The adjustable goal according to claim 1 further comprising:

a forward guide channel on an underside of said central member for slidably receiving a forward portion of said first sliding member and said second sliding member.

4. The adjustable goal according to claim 1 further comprising:

a rearward guide channel on an underside of said central member for slidably receiving a trailing edge of said first sliding member and said second sliding member.

5. The adjustable goal according to claim 1 wherein:

said central member, said first sliding member and said second sliding member define a front opening for receiving an object.

6. The adjustable goal according to claim 1 wherein:

said central member, said first sliding member and said second sliding member define a rearward opening for allowing an object to pass into a receptacle.

7. The adjustable goal according to claim 1 wherein:

said first sliding member and said second sliding member abut an end wall of the air hockey game;

a first post extending rearwardly from said first sliding member;

a second post extending rearwardly from said second sliding member;

wherein said first post and said second post are adapted to engage a selected hole defined by said end wall for setting a width at a desired discrete increment.

8. An adjustable goal for a table top air hockey game comprising;

a central member;

a first sliding member having a positioning post extending from a rearward surface, said first sliding member slidably engaged with said central member;

a second sliding member having a positioning post extending from a rearward surface, said second sliding member slidably engaged with said central member;

wherein said positioning posts are sized to be slidably received in a selected orifice for positioning said first sliding member and said second sliding member at repeatable and discrete positions relative to said central member.

9. A hockey game table comprising:

a game surface having a first end and having first and second sides;

a first end wall adjacent said first end of said game surface, said first end wall defining a plurality of orifices;

an adjustable goal comprising a first sliding member having a rearwardly projecting positioning post affixed thereto for locating in a selected one of said plurality of orifices;

said adjustable goal proximate said first end wall wherein said adjustable goal defines a forward opening sized to receive an air hockey puck, said forward opening having an adjustable width.

* * * * *